US009795198B1

(12) United States Patent
Krieger

(10) Patent No.: US 9,795,198 B1
(45) Date of Patent: Oct. 24, 2017

(54) BAND AND SLIDER

(71) Applicant: Brien Robert Krieger, Avon, IN (US)

(72) Inventor: Brien Robert Krieger, Avon, IN (US)

( * ) Notice: Subject to any disclaimer, the term of this patent is extended or adjusted under 35 U.S.C. 154(b) by 0 days.

(21) Appl. No.: 14/991,921

(22) Filed: Jan. 9, 2016

(51) Int. Cl.
*A44C 5/00* (2006.01)

(52) U.S. Cl.
CPC ..... *A44C 5/0015* (2013.01); *A44C 5/0084* (2013.01)

(58) Field of Classification Search
CPC .... A44C 5/0015; A44C 5/0007; A44C 5/0084
See application file for complete search history.

(56) References Cited

U.S. PATENT DOCUMENTS 2,653,402 A * 9/1953 Bonagura ..... A44C 9/00 40/618
6,880,364 B1 * 4/2005 Vidolin ..... A44C 5/025 40/633
7,331,707 B2 * 2/2008 DelValle ..... A44C 5/0015 116/308
2008/0261187 A1 * 10/2008 Pierce ..... A44C 5/0015 434/238
2011/0061424 A1 * 3/2011 Gupta ..... A44C 5/0015 63/1.13
2014/0223961 A1 * 8/2014 Mullins ..... A44C 5/0015 63/1.13

* cited by examiner

*Primary Examiner* — Daniel J Colilla

(57) ABSTRACT

A wearable or stationary cognitive reminder for mechanical and electronic tracking of highly repeatable actions represented by selectable indicia on a band performed by moving a slide-able "window" frame and a bezel ring slider. Examples of use are: pill dosage counter, golf bracelet scorer, and bracelet voting device. Chosen indicia position and clock time are recorded and transmitted to non-included electronic device for further characterization or action. Non-included data receivers include cell phones, data tracking devices, or electronic games. Transferred data is available for continuous tracking, compilation, additional action, and verification of selected indicia.

15 Claims, 19 Drawing Sheets

Fig. 1 Pill Bottle Example
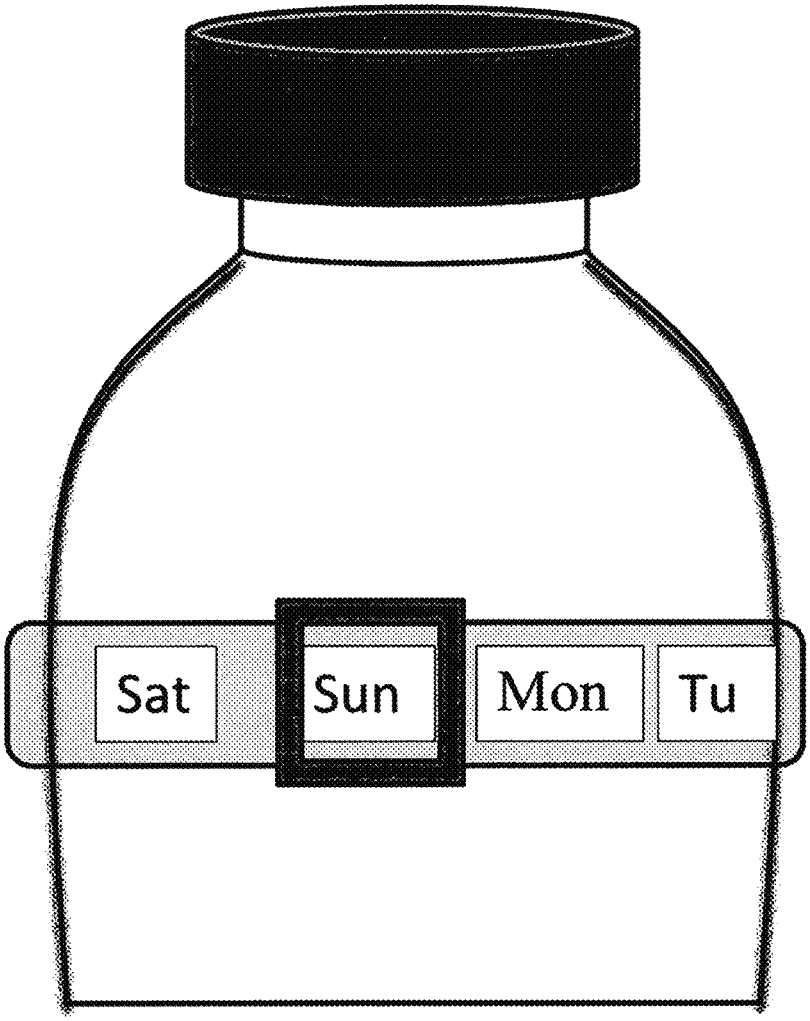

Fig. 2 Band and Slider with Rotating Ring (BSRRI) in Electronic Form
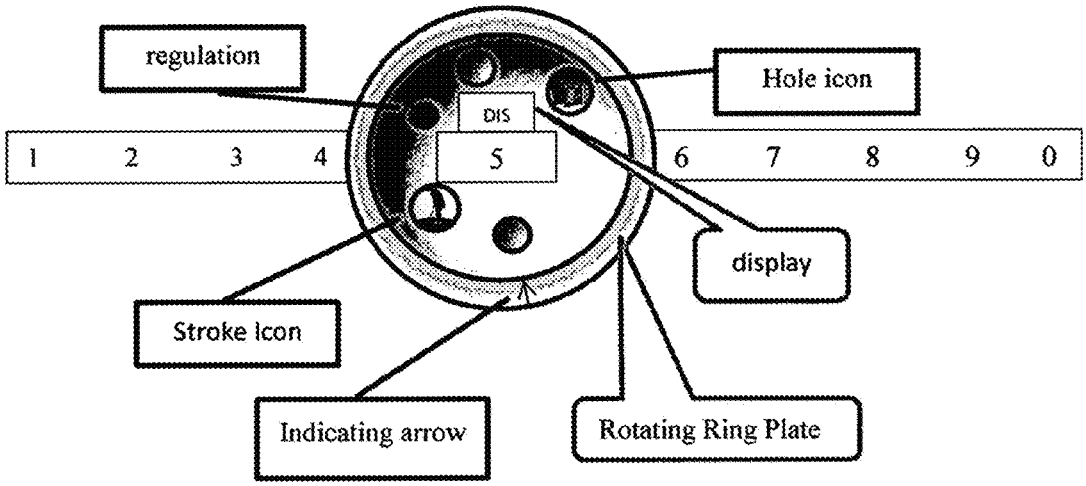

Fig. 3 Mechanical and Electronic Design Flow
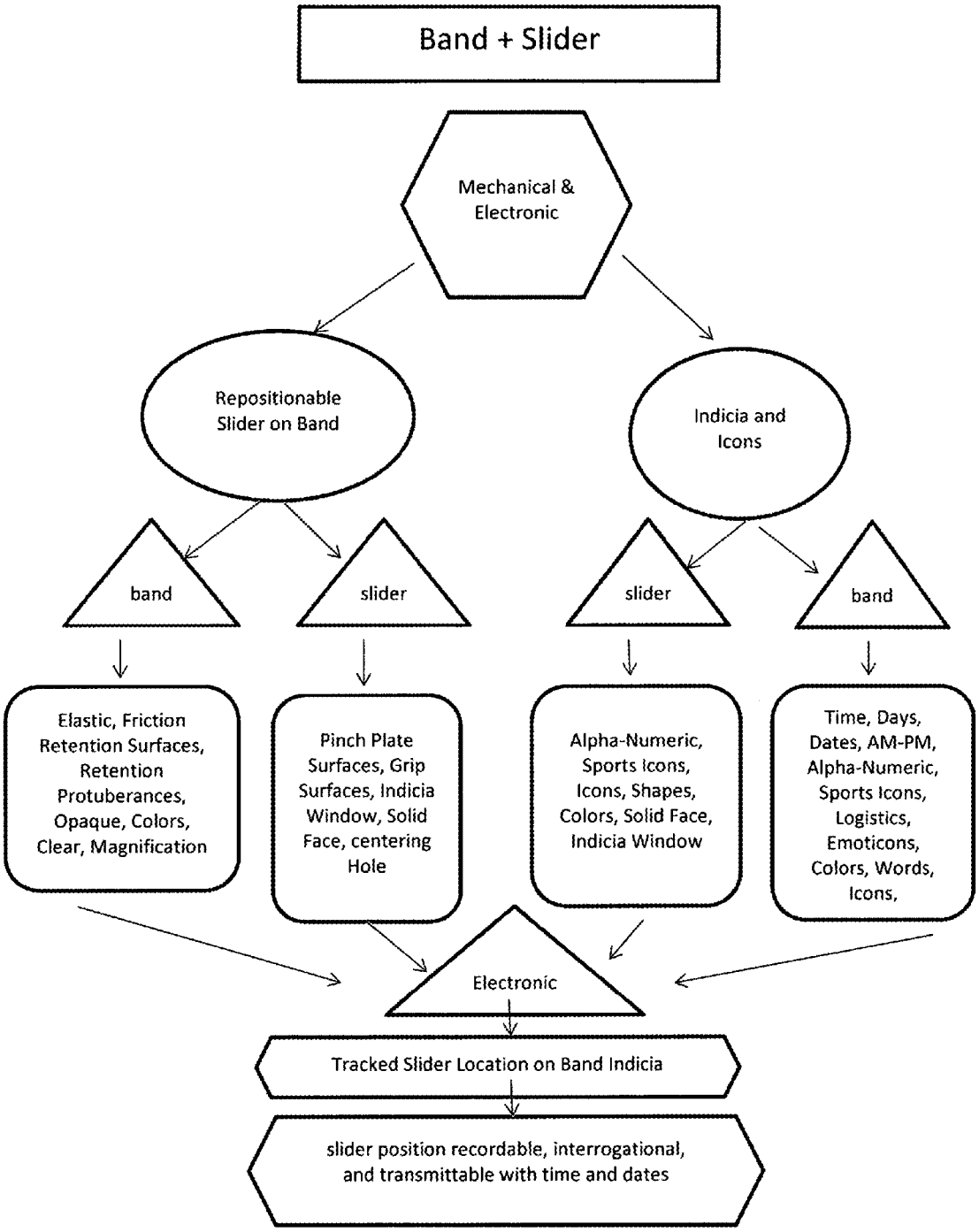

Fig. 4 Logic Schematic for Golf Scorer
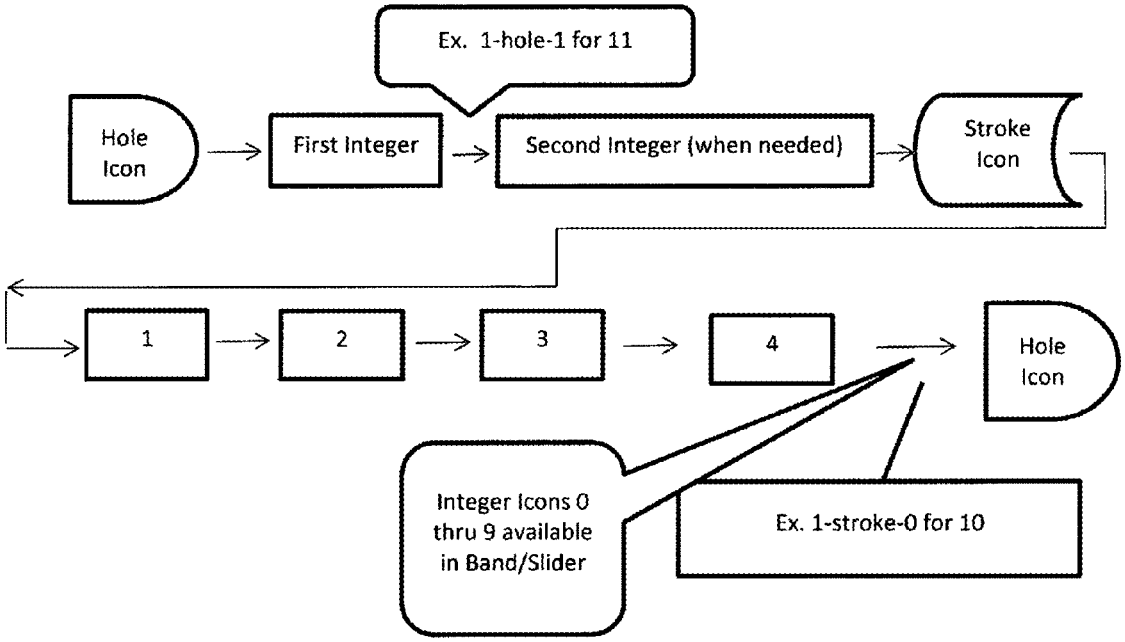

Fig. 5 Invention on Pill Bottle
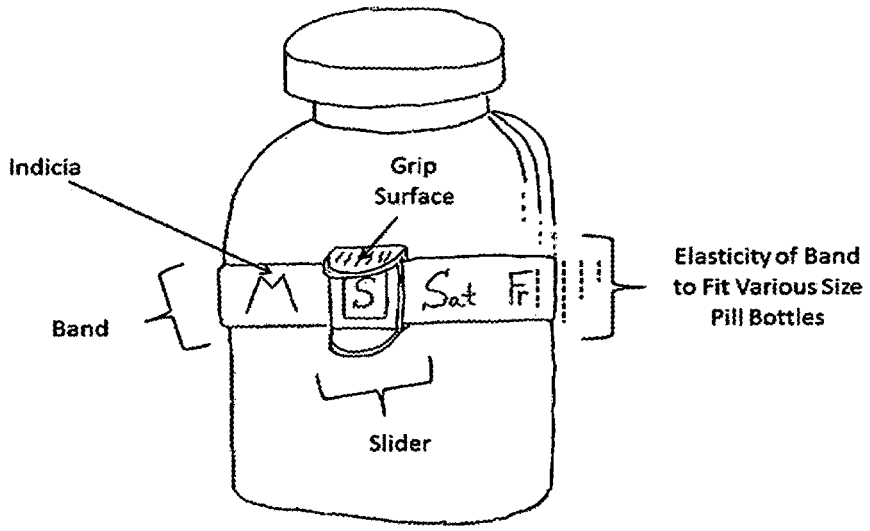

Fig. 6 Slider, Front Face
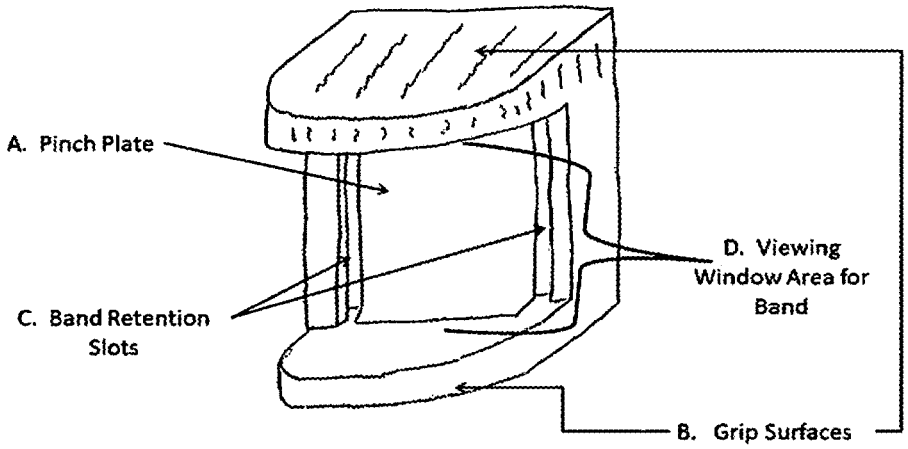

Fig. 7 Slider – Straight Thru Back
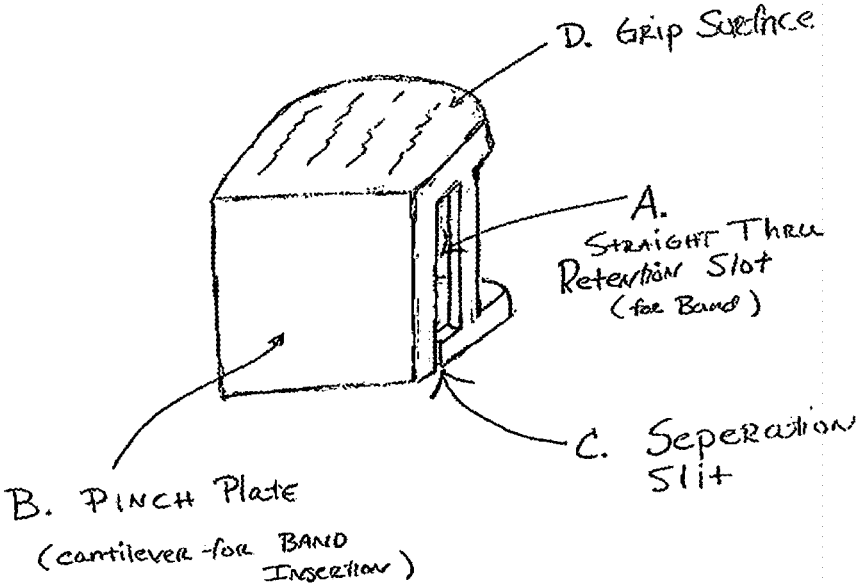

Fig. 8 Slider – Serpentine Back
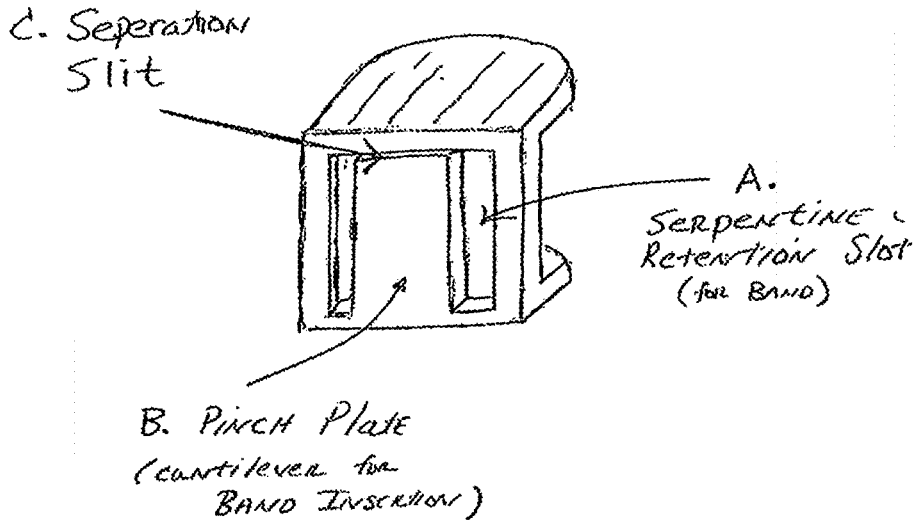

Fig. 9 Band
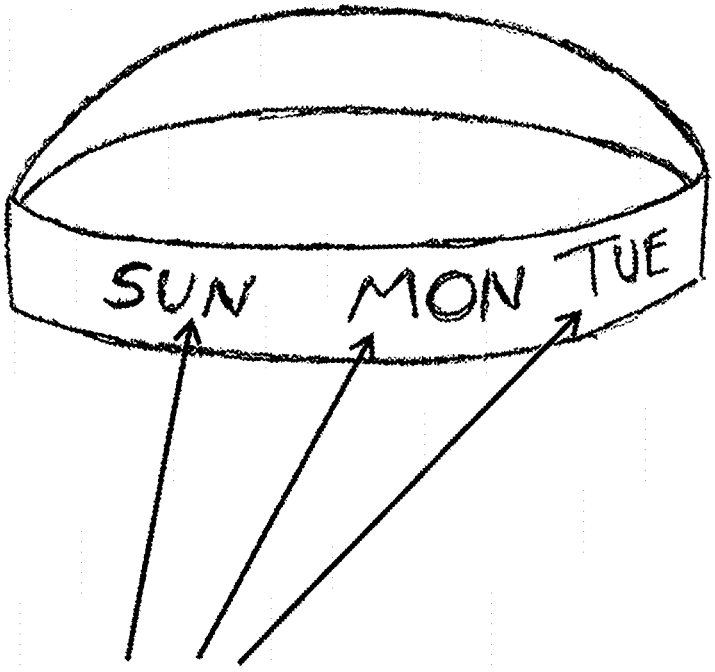
A. Indicia

Fig. 10 Invention on Wrist
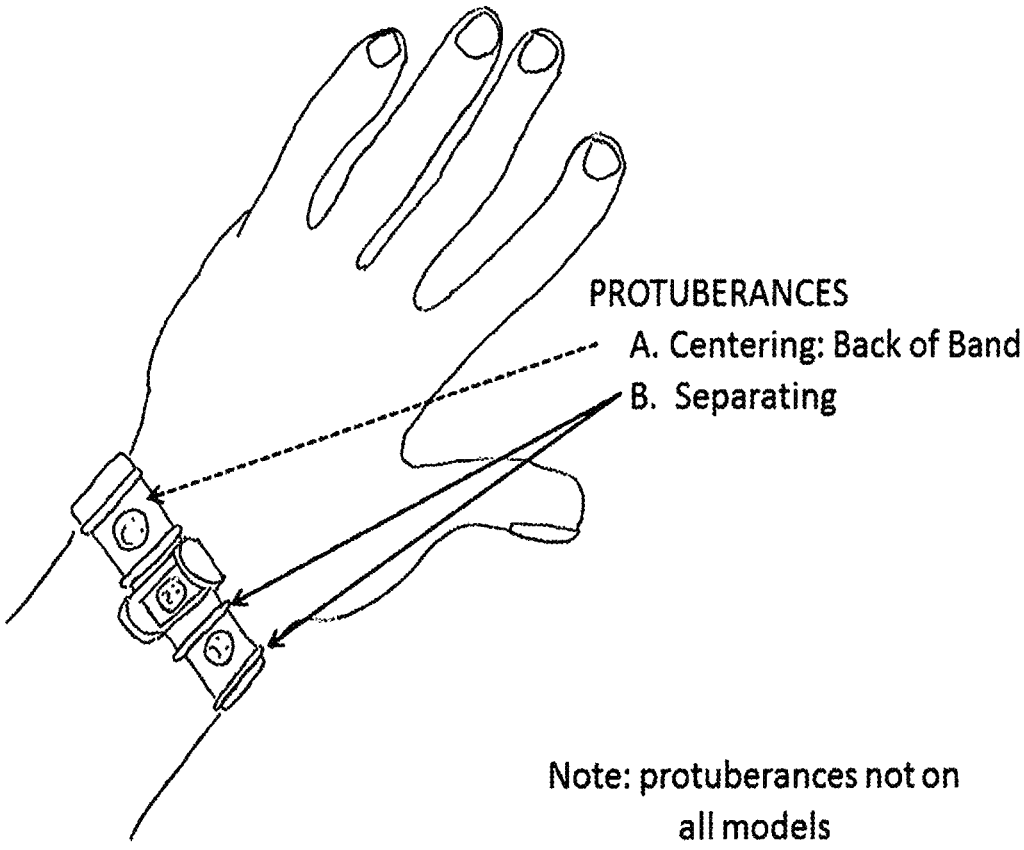

Fig. 11 Band with Protuberances
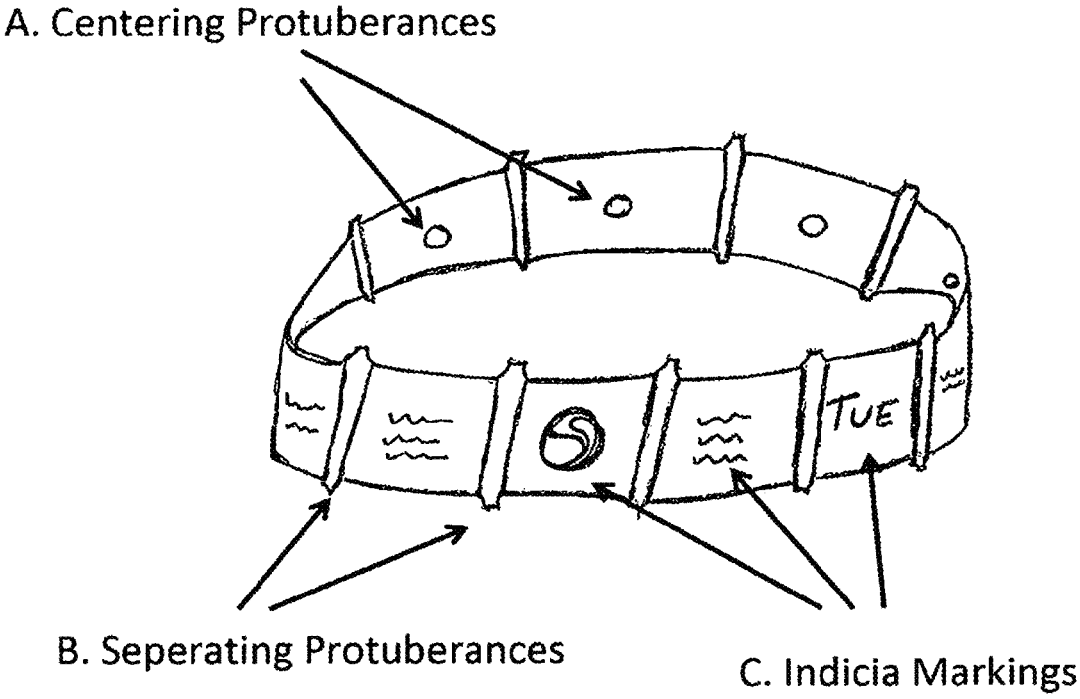

Fig. 12 Slider with Centering Hole in Pinch Plate
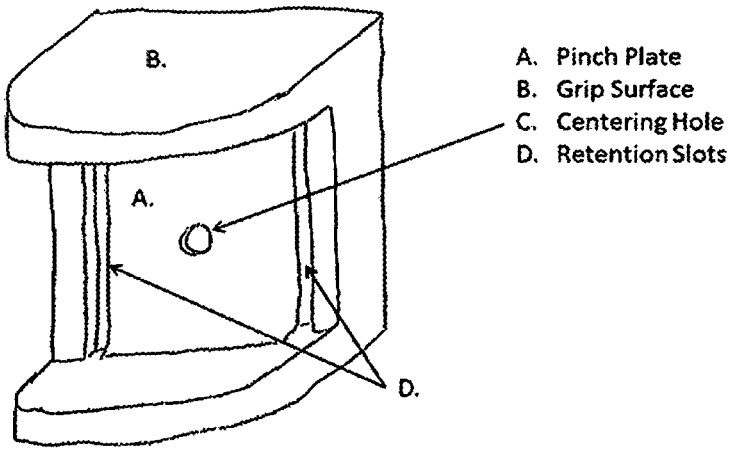

Fig. 13 Slider – Heart Front and Grip Surface
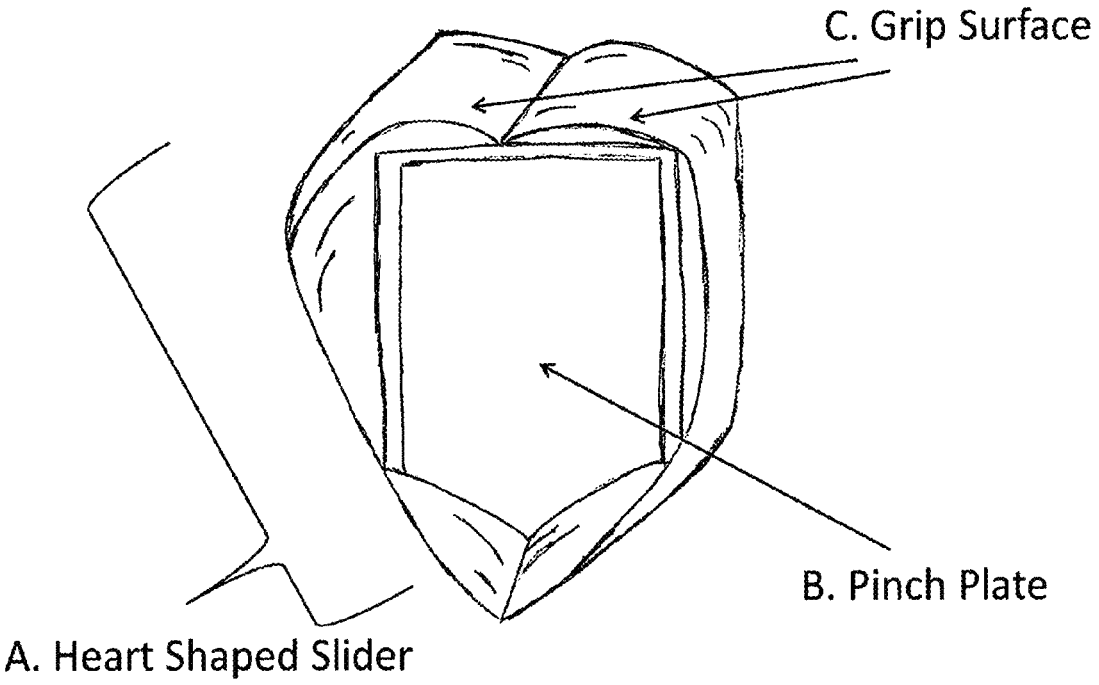

Fig. 14 Monitoring Band and Slider – position recognition
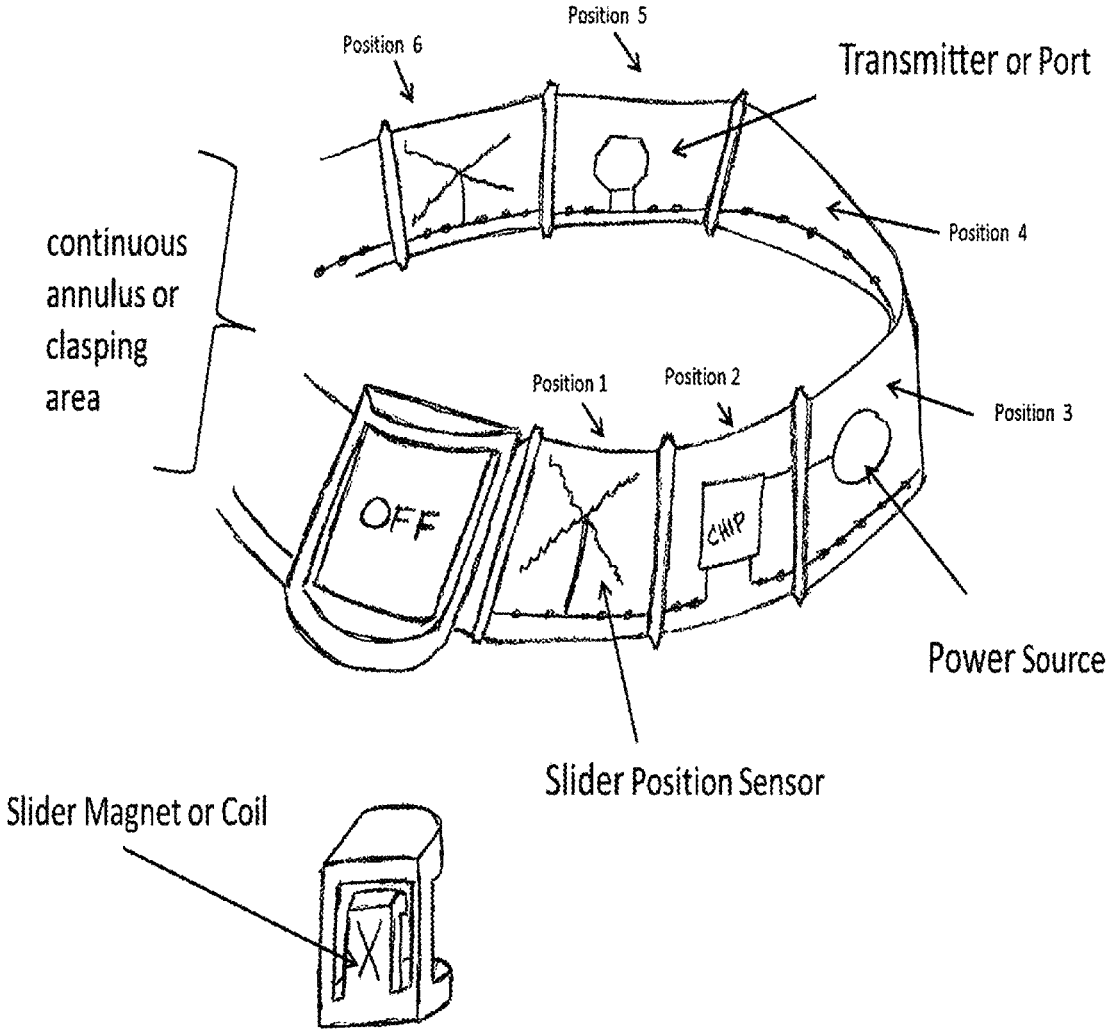

Fig. 15 Two Piece Slider
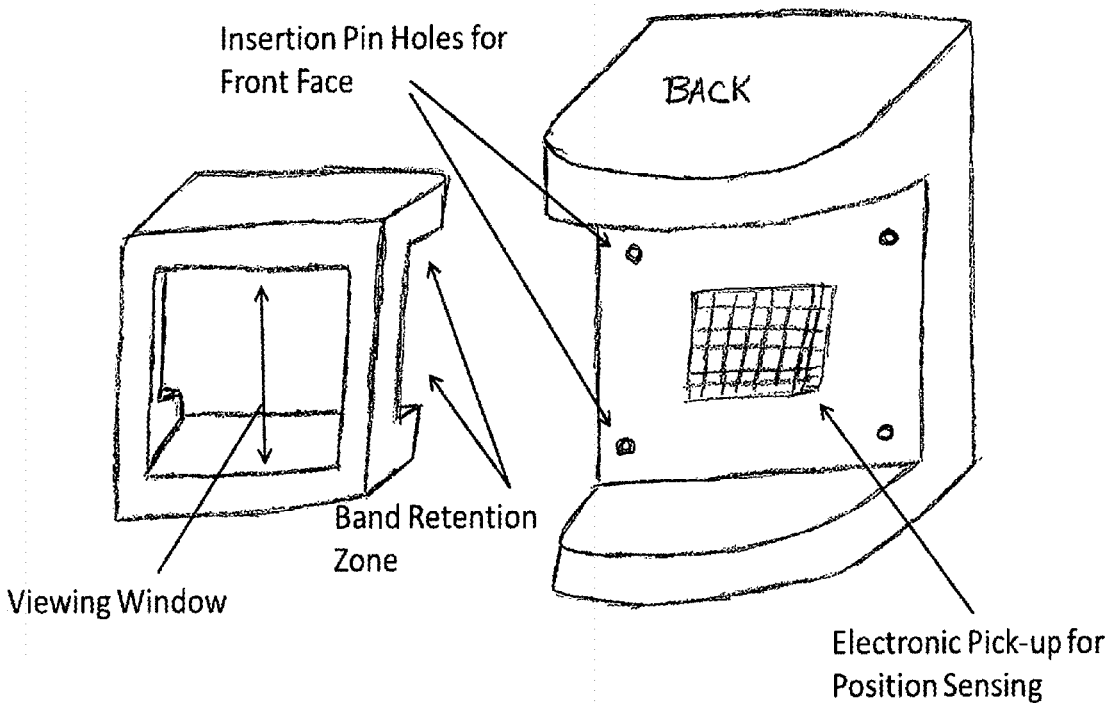

Figure 16. Rotating Ring (AM-PM Daily Dosage)
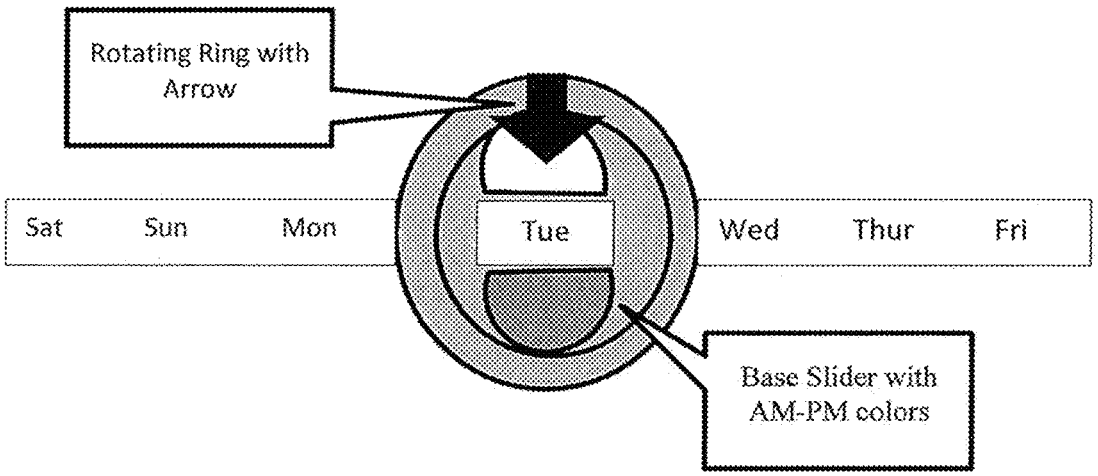

Figure 17. AM-PM Band with Rotating Ring
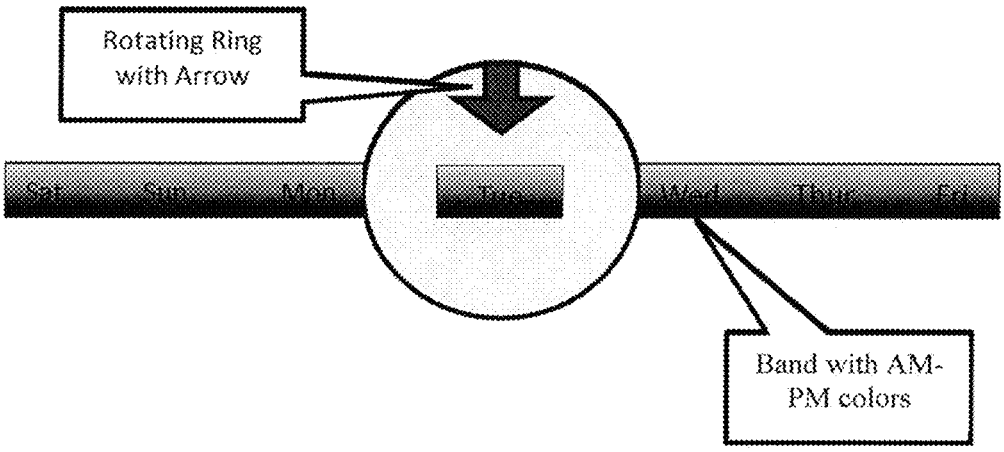

Fig. 18 Simple Golf Wristlet
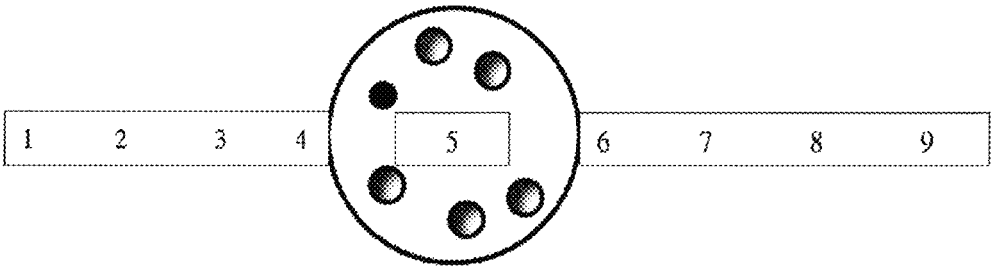

Figure 19. Golf Wristlet with Rotating Ring and Electronics
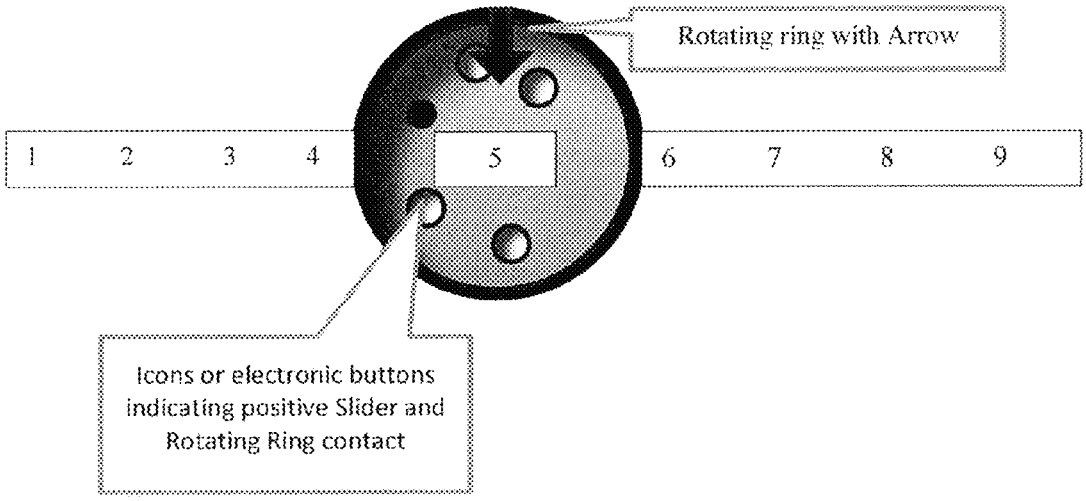

BAND AND SLIDER

FIELD OF INVENTION

This patent application is for an invention that is a reminder and tracker for repeatable functions, scoring, or counting. The invented device is placed, but removable and reusable, on or around a non-included unit such as pill bottle or wrist.

BACKGROUND

In many cases, actions performed may be forgotten because of mindless repetition, no record keeping coupled to the repeated action, and not physically engaging while being performed. These functions are repeatable and sequenced. Some need visual confirmation and a record of actions in order to be verified.

Administering pill dosage is repetitive and sometimes forgotten. Prescription labels and non-prescription labels provide information such as: drug name, dosage, doctor name, pharmacy phone number, and other requirements. Non-clear containers and child prevention caps are required. Prescription manufactures, pharmacists, and doctors do not want packaging interference and redesign can be costly. There are dosage reminders that interfere with existing packaging, labeling, or require additional handling.

Tracking golf strokes per hole is highly repeatable and golfers may forget their strokes as the hole progresses. The traditional method of scoring golf is not tracked until a hole is complete and written down on the score card.

Popular elastic mechanical message wrist bands communicate one message and don't allow for altering communique', mood, or mode. Electronic wearables are typically of two categories: phone/internet or single function programmed monitoring. Phone and internet interactive wearables have small display or touch screens, limited battery capacity or limited function. Many are bulky, heavy and costly.

Programmed wearables tend towards monitoring human health or motion with high performance body sensors.

There are many repeatable actions needing cognitive recognition as performed along with both mechanical and electronic tracking methods. There are few unobtrusive versatile cognitive trackers for highly repetitive actions that can be located on the person or a non-included unit.

SUMMARY

A slider frames indicia on an elastic band thus informing, reminding, and tracking repeatable actions: pill dosage administered, golf strokes, simple voting, caloric intake, actions required for completion, calendars, or general communique'/interests. For the pill dosage model (FIG. 1), the elastic band and slider is stretched onto the bottle containing the pills or around the user's wrist. As the dosage is administered, the slider is positioned over indicia indicating the next required dosage: such as daily maximum quantity or the next day of the week. If dosage administration is forgotten, the user reviews the band indicia designated by the slider and compares the selected indicia to the present day of the week. A rotatable ring with a coincident window over the slider frame offers the band and slider additional indicia definition. The acronym, 'BSRRI', is used when the bezel rotatable ring is added to the band and slider creating the band/slider/rotatable ring/indicia. In the electronic version (FIG. 2), the slider position and time are tracked, saved, and communicated to a remote device such as cell phone for further use and position characterization.

Mechanically, the advantage of selectable band indicia through slider or rotatable ring repositioning is to display various useful and repeatable communiques while enhancing cognitive awareness of action. It is removable, reusable, and resides on the non-included device with band elasticity. The invention, BSRRI, does not create permanent markings nor interfere with existing labels.

The elastic characteristic allows one non-stretched band diameter to fit various diameters and shapes of the non-included surface. Also, various like items that necessitate like communiques can be bundled with a single band and slider. Stretched band and slider contact on the non-included surface creates additional friction for the slider to remain in relative position. Band protuberances assist in keeping the relative position of the slider to the band.

In electronic form, weight, battery requirements, and cost of a wearable device are reduced by eliminating a fully functional display or touch screen when only discrete representations are sufficient.

This is achieved by utilizing repeatable permanent band icons that can be further defined or utilized in a remote non-included device: example cell phone application.

Advantages of the electronic band and slider invention are: recognizable local visual band indicia and binary logic of on/off slider position. The invention can be worn on the wrist, placed over a pill bottle, or stretched over appropriately sized non-included items. The slider position/time data is transmitted to a non-included receiver. The slider electronic contact switch on band eliminates tiny buttons, a touch screen, single applications, and key strokes that many mobile devices utilize.

OBJECTS OF INVENTION

The band and slider has various medical, sports, artistic, communication, voting, and packaging uses when limited variances are necessary for communication. The band and slider with applicable indicia can be placed around non-included units such as: pill bottles, wrists, paper work, perishable goods, or mail bundles due to its elastic design.

The design inception is for usage as a dosage tracker placed on a pill bottle or on a person's wrist. The slider is repositioned from day of week (ex. Sun) to new day of the week (ex. Mon) when the daily pill is consumed. Daily multiple dosage band indicia require whole numbers sequences (ex. 1 thru 9) where the slider position indicates each increasing dosage consumed for that day. Another band design includes am and pm demarcation or yellow and gray colors (night/day) with the day of week so two doses per day can be tracked. These additional parameters can be track with the addition of the rotating bezel ring when band indicia are limited by band circumference.

In the pill bottle application, for example, the band and slider is of two different embodiments yet based on slider position framing band indicia. One is mechanical only and the other is of both mechanical and electronic design. In the latter form, dosage administration is electronically captured by the slider position on the band. The repositioned slider indicates pill consumption and is transmitted to the local non-included receiver. The non-included receiver can be interrogated or transmit band and slider consumption tally data to health personnel or care givers. The pill bottle dosage application can be sized as a wristlet reminder tracker or placed directly on pill bottle.

Band indicia are characteristic of application. In wristlet form, the band and slider is placed over the hand and onto the wrist with indicia for exercise, caloric consumption, player jersey number per team, golf strokes, voting or an emotional mood. The indicia on the band can be limitless; but the slider position on band indicia is the unique mode of communique with additional modes created with the rotating ring.

In electronic form, residence time of slider or bezel on indicia is logged. The exercise band and slider tracks time duration for: walking, running, sitting, standing, lifting weights, and general aerobics. The non-included device software characterizes the band qualities uniquely associated with each slider position while totalizing and comparing against time, days, weeks, or year when desired.

Mechanical visuals and the feel of repositioning the slider and rotating ring create cognitive modes for repeatable actions; coupled with electronic interface these actions are permanently tracked.

DESCRIPTION OF EMBODIMENTS

The Band and Slider is a Band with indicia and an integral repositionable Slider where the Slider's viewing window frame centers on one Band indicia to indicate and communicate the intended message. Band elasticity, Band protuberances and the Slider's pinch plate keep the Slider from shifting off the chosen Band indicia.

The Slider's position on the Band's indicia communicates an action performed, to be performed, to convey a conditional state, or a message. The Slider remains on the Band's relative position until the Slider is repositioned to another Band position indicating a different characteristic or mode. The new conditional state is indicated by the different Slider position with the viewing window frame surrounding the different indicated indicia.

Band elasticity allows the invention (FIG. 5. Invention on Pill Bottle) to stretch over various shaped non-included application units (FIG. 1. Pill Bottle Example). The repositionable Slider with viewing frame (FIG. 6) surrounds one Band indicia (FIG. 9) thus indicating and communicating the relative conditional state of the non-included unit.

Elastic forces (Table A) create contact friction between invention surfaces (included) and application surfaces (non-included) enabling the Slider to hold its relative position on the Band.

TABLE A

Elastic Forces: Example Band Size to Application Size Typical Circumferential Measurements of Invention for Pill Bottle Example

| Band natural state circumference (cm) | Minimum pill bottle size | Maximum pill bottle size |
|---|---|---|
| 22 (wristlet size) | | |
| 15.5 | 16 | 25 |
| 13 | 14 | 21 |
| 9 | 10 | 15 |

When contacting a non-included unit elasticity pulls the Slider and Band against the non-included unit keeping the Band and Slider on the application and aiding Slider position retention. The invention's included frictional features and band protuberances (FIG. 11. Band with Protuberances) retain the Slider over the chosen indicia when Band elasticity does not force Band and Slider contact onto the application (FIG. 10. Invention on Wrist).

The Slider (FIG. 6. Slider, front face) has grip surfaces (FIG. 6B) for grasping and pulling the Slider along the Band; thus the Band slides through the Slider retention slots (FIG. 7A.). When required, a serpentine arrangement (FIG. 8A) creates greater frictional force between the Band and the Slider's pinch plate (FIGS. 6A, 3B, and 4A). Band protuberances are added (FIG. 11) to assist in Slider retention over the chosen indicia and also reduce Band slippage when contacting the non-included unit.

The Band and Slider invention can be configured as a mechanical form or a mechanical/electronic form. Design characteristics are added as the Band and Slider morphs from mechanical to mechanical/electronic (FIG. 3. Mechanical and Electronic Design Flow, Table B. Mechanical and Electronic Band and Slider Characteristics).

TABLE B

Mechanical and Electronic Band and Slider Characteristics

| SLIDER | BAND | ROTATING RING |
|---|---|---|
| MECHANICAL INDICIA INDICATING | | |
| Viewing window frame | Indicia | Bezel detents |
| Grip surface | Icons | Indicia |
| Pinch plate | Elastic | Icons |
| Retention slots | Protuberances | |
| Centering hole | | |
| One piece | | |
| Two piece | | |
| ELECTRONIC INDICIA RECOGNITION | | |
| Position sensor | Position sensor | Position sensor |
| | Continuity Indicating | Continuity Indicating |
| | Data storage - Chip | Data storage - Chip |
| | Time clock | Time clock |
| | Data transmittal | Data transmittal |
| | Data receipt confirmation | Data receipt confirmation |
| | Data retrieval | Data retrieval |
| | Power source | Power source |

The electronic configuration allows for receipt of digital position data through radio frequency or cell phone frequencies. Receipt confirmation or a limited discrete inbound acknowledgement is in the most advanced electronic design.

The Slider of the Band has enhanced functionality by adding a rotating component around the Slider's window frame. The rotating Slider component adds modes of additional information to the framed Band indicia. The Slider base unit has sections or icons that can be indicated by the Slider's Rotating Ring. The acronym BSRRI is used for Band/Slider/Rotating Ring with Indicia.

The Rotating Ring component has an arrow or line that will index to the desired Slider base section or point to the top/bottom half of the Band indicia. The Band's entire indicia meaning consists of Slider's framed indicia and the additional mode indicated by the position of the Rotating Ring. The base Slider is sectioned into halves, triads, quads, multiple sections, or icons dictated by the application. The indexed Icon position of the rotating component is indicated visually and stored in electronic form.

Example, the windowed indicia is day-of-week (Tue) but enhanced by Slider base sections of morning and evening icons or AM/PM, or representative colors (FIG. 16. Rotating Ring AM-PM Daily Dosage). Duality of the Band indicia can also be achieved by a two color Band; the top half and the bottom half. The AM top portion could be yellow with the bottom PM portion black (FIG. 17. AM-PM Band with Rotating Ring); while the indicia are days-of-week. The Rotating Ring is repositioned to indicate AM to PM for that day after morning dosage is administered. The entirety of the Slider and Band communicates twice a day pill dosage by rotating the Ring from morning to evening for the framed day.

Additionally, the multiple selectable communiques on a single Band eliminate multiple bands of similar characteristics and allow for a few highly repeated communiques either in the mechanical or electronic form.

The Band:

Examples of the Band indicia are: time sequences, emoticons, icons, words or numbers. The Band material is thermoplastic with elastic properties. The Band may be opaque, clear, or magnifying as application requires and is of annulus form or linear form with connectable ends such as buckles or Velcro™.

Contact by routing the Band through the Slider, Band elasticity, and protuberances on the Band provide frictional forces for Slider position retention. The frictional forces are large enough to prevent unintentional Slider movement but small enough for repositioning with intension. The Band protuberances assist in mechanical separation of Band indicia.

The annulus Band will have various circumferences, widths, and thickness dependent on the application. In a typical pill bottle design the elastomeric annulus width, in its un-stretched natural state, would typically be 8 to 12 mm. This allows for the stretched (taught) invention to have sufficient contact friction on all surfaces and retain legibility of the indicia. The thickness is 1 mm in the natural state condition. The Table A presents typical dimensional characteristics of Band sizes for pill bottle application and wrist application.

The Indicia size is dependent on the annulus size and the Indicia characters. The smallest Band's Indicia representing the 7 days of the week are 10 to 12 mm long. This allows for larger print for readability and space for protuberance on the face clear separation between the Indicia limiting confusion on the Slider indication.

Band with Protuberances (FIG. 11) shows protuberances that are integral with the Band and of the same material. The protuberances can be incorporated as part of the indicia (ex. raised lettering) and/or on other locations of the Band. The design friction is created between the Band, Slider, and the non-included unit (ex. pill bottle) to remain in the desired position. FIG. 9, The Band, shows a band with protuberances where the elastic forces are great enough to hold Band and Slider in position.

The protuberances keep the Slider from inadvertently moving to another position. The integral side separating Protuberances (7B) extend from the Band edge and faces with a protuberance slightly wider than the Slider retention slots. Protuberances flex to slide through the retention slots of the Pinch Plate. The centering Protuberance (7A) mates with a centering hole (8C) of alternate Pinch Plate design (FIG. 12. Slider with Centering Hole in Pinch Plate).

The Separating Protuberances (7B) are located between communiques prohibiting unintended movement of the Slider "window" off of the intended communique. The Band protuberances contact the Slider retention slot during unintentional position change therefore retaining the viewing window over the chosen indicia. The side protuberances are side hairs or wedge shaped or raised flats extending on front, back, or edge of Band. In addition to preventing unintentional movement they provide physical separation between the Indicia.

The Centering Protuberances (7A) are integral and of the same material as the Band. The Protuberances fractionally extend away from the flat portion of the band. The centering protuberances, dimple or nodule, are placed on the opposite face of the Band visual communique and are used to engage centering hole in Slider back plate. Typically used for electronic version but may be required on non-electronic. In electronic version the Centering Protuberances are typically part of the position sensors.

Protuberances are flexible and impinge on the Slider's Retention Slot or Pinch Plate centering hole. The Slider temporarily deforms the protuberance as the Slider moves across the protuberance and onto a different communique. The Protuberances on the smallest annulus are 2 mm in diameter or width and will extend 1 mm perpendicular from the band surface. The protuberance size will be proportional with the Band size and characteristics.

The Slider:

The Slider clasps the Band but is repositionable to various locations on the Band. The Slider's front is a frame opening. This aperture surrounds or points to each unique Band indicia. The selected Band's communique is viewable through the Slider frontal opening thus communicating the chosen Band indicia. The Slider and Band have frictional surfaces holding the Slider relative position until repositioned.

The Slider has a clasp arrangement where the openings allow the annulus Band to slip onto the Slider during assembly. The Slider clasping slots of the Pinch Plate zone are fractionally wider than the Band width and create Band offsets that create frictional surfaces between the Band and the Slider.

The Slider's Pinch Plate is used during Band and Slider assembly, Band retention within Slider, and Band and Slider friction against a non-included device. The Pinch Plate is configured in two designs. One design clips over the Band for a straight through passage of the Band through the Slider. The straight through slots are rectangular and fractionally larger than the Band to avoid pinching the Band.

The second configuration of the Pinch Plates creates a serpentine configuration of the Band creating additional friction between the Band and the Slider. A two-piece Slider design (FIG. 15. Two Piece Slider) is utilized in potentially difficult Band and Slider assembly situations and when electronics are more easily manufactured into one piece of the two piece Slider design.

The vertical side slots around the Pinch Plate hold the Band in a slight curve or serpentine shape around the Pinch Plate while exposing the Band's communique in front. The Pinch Plate design holds the Slider in position against the Band and the non-included unit while also allowing the Slider to be repositioned on the Band. The three Pinch Plate (sides and top) opening widths are slightly larger than the width of the Band. The frictional forces between the Band and Slider are created with the serpentine arrangement of the Band. Frictional forces are also applied to the Slider by the elastic characteristic of the Band.

The artistic Slider (FIG. 13 Slider—Heart Front and Grip Surface) frontal area is shaped as various logos but still employs the clasping slot arrangement. Logo and icon Sliders have frontal shapes such as hearts, arrows, the Indianapolis Colts Horseshoe, the remembrance/charity Fold-Over Ribbon, or others. Icon shaped Slider frontal areas that surround the frame opening have grip surfaces incorporated.

The Rotating Ring:

The Band and Slider with Rotating Ring acronym is BSSRI. The Rotating Ring is of bezel design that can point to specific locations on the fixed component of the base Slider or the top half/bottom half of the Band. The Rotating Ring has a centered opening that does not interfere with the Band indicia framed by the base unit Slider. Band and Slider with Rotating Ring (BSRRI) in electronic form is in FIG. 2. The BSRRI incorporates electronic position sensing for the base Slider and the Rotating bezel Ring.

The Electronics:

The electronic band and slider (FIG. 14) recognizes slider position on band with slider to band electronic contacts and Rotating Ring to base unit Slider contacts. These framed or indicated Indicia positions are electronically recognized through effect sensors or circuit continuity. The Slider's residence time on an indicia are recorded and transmitted to a non-included device where additional instructions are completed. Time and date functions may be included in some non-included applications. The clock time and new position is recorded and can be transmitted when the Slider is repositioned, programmed to deliver at time intervals or downloaded. In summary, the following are embodiments of the electronic form of Band and Slider.

1. Relative Slider position and Rotating Ring and clock time are recorded, retrieved, or transmitted from Band and Slider. The relative position against time is retained therefore time duration of position is captured.
2. The indicia positions have remote definitions, instructions, and functions. Long term use and manipulation of data is performed in the non-included device.
3. Specific Indicia initiate data transfer with remote device and reset of Band data.
4. Electronic monitoring Band and Slider contain power source, data chip, Slider position sensor, Rotating Ring position sensor, Band identifier, and transmitter.
5. A predetermined sequence of Indicia may be required when using Indicia integers 0 through nine to obtain two or three digit integers (FIG. 4)

Band Indicia:

The Indicia or Function: examples or in combination: Pill Bottles, Golf Strokes, Caloric Intake, Marathon Mileage, Food Containers, Packages, Drink Containers, Packages, Consumable Quantities, Bandage Day Tracker, Dates, Relative Position, Time, Quantities, and Specific Directions.

These are Indicia examples that would be viewable through the Slider window frame. Viewable Indicia may be abbreviated due to Band circumferential limitations. Most have demarcations between whole framed Indicia for fractional values.

Time—

1. Day of the Week—SUN, M, T, W, TH, F, SAT
2. Month—Jan, Feb, Mar, Apr, May, Jun, Jul, . . . .
3. AM—PM
4. Due—$1^{st}$ qtr, $2^{nd}$ qtr. $3^{rd}$ qtr. $4^{th}$ qtr.

Quantity—

1. Daily Dosage—1, 2, 3, 4, 5, 6 OR 2, 4, 6, 8
2. Caloric Intake—250, 500, 1000, 1500, 2000, 2250, 2250+++
3. Mileage—1, 2, 3, 5, 8, 10, 11, 12, 13.2
4. Kilometers—1, 3, 5, 10, 15, 20
5. Night—Day
6. Breakfast, Lunch, Dinner Relative Position, Numbers, Lettering, Signatures, Sequences—

1. 1, 2, 3, 4, 5, 6, 7, 8, . . .
2. A, B, C, D, E, F, G, H,
3. COLTS Ring of Honor: #18, #11, #39, #24, . . .
4. COLTS '13: 12, 80, 50, 34, . . .

Possession—

1. Mom, Dad, Son, Daughter
2. Mine, Yours, Anybody
3. WS1, WS2, WS3, WS4 (work station)

Logistics and Portability—

1. Ready, Not Ready
2. Check, Expedite, Normal, Deliver
3. HEAVY—LIGHT
4. Expedite, Not Rush, Fragile, International, Repack Words—

4. YES—NO
5. Love Me—Love Me Not
6. True—False—Maybe—NOT
7. Please, Thanks, Welcome
8. Emergency, Call Friend,
9. Clean, Dirty, Wash
10. Love, joy, friend
11. Low Cal, Regular, No Mayo
12. Agree, Disagree Emoticons, Characters, Colors—

1. SMILEY, SAD FACE, FROWN, MAD
1. Red, Yellow, Green
2. Black—White

Pill Dosage Tracker and Reminder

The Pill Bottle Example (FIG. 1) is a reminder and recorder of pill dosage. Integers or Icons on Band represent the dosage over a defined period of time. The Band and Slider on (FIG. 5. Invention on Pill Bottle) tracks daily consumption for a period of one week. The Slider frames "S" an abbreviation for Sunday; therefore, the Sunday dosage has not been administered presuming the user moved the Slider to "S" upon taking the "Sat" dosage.

Golf Wristlet Scorer

The Simple Golf Wristlet Scorer (FIG. 18) is a reminder and recorder of golf strokes on a per hole basis. Integers or icons for Band indicia represent stroke count. The repetitive use of integers (0-9) or the combination of them in golf allows for simple hole and score tracking. The Slider is moved to the number of strokes used per hole. In a variant, eighteen Rotating Ring indices are available on the base Slider tracking golf strokes against hole number and is applicable to electronic and mechanical forms.

The electronic Golf Wristlet Scorer has forms with and without the Rotating Ring. The Simple Golf Scorer can track a round of golf with integers, a stroke icon and a hole icon. Additional features can be completed by adding the Rotating Ring. The embedded chip logic along (FIG. 4) with Slider position tracks strokes per hole.

The Band and Slider with Rotating Ring (BSRRI) in Electronic form (FIG. 2) has a combination of electronic pickups at Slider and Rotating Ring. BSRRI electronic forms have a display validating mode and data delivery. The addition of a Rotating Ring (FIG. 19. Golf Wristlet with Rotating Ring and Electronics) and with electronic pickups on the Base unit Slider and Rotating Ring add dimensions of stroke/hole characterization such as: putting, handicapped hole, and stroke regulation. The hole number, the strokes per hole, and if stroke is within regulation are tracked and downloaded to the non-included electronic device for characterizing the user's performance.

Voting

The Voting example is shown in FIG. 10. Invention on Wrist. The example icons are a smiley face, a frowning face, and an indifferent face as framed with the Slider. A sport favorites design displays players' jersey numbers for a specific team allowing the user to select their favorite player. Additionally, when a "yes" or "no" icon and electronics are added, the user can vote in agreement or disagreement to a referee's call. The Voting Band and Slider can be mechanical only or mechanical/electronic in design.

BRIEF DESCRIPTIONS OF DRAWINGS

FIG. 1. Pill Bottle Example: This is the origin of idea for Band and Slider invention. The depiction shows the tracking device directly placed on a pill bottle with the Indicia and Slider in position framing the abbreviated spelling, Sun, for Sunday.

FIG. 2. Band and Slider with Rotating Ring (BSRRI) in Electronic Form: This is the culmination of major embodiments; specifically Band, Slider, Rotating Ring, Electronics, and Display for the Band and Slider invention. The usage of invention depicted is for golf stroke tracking. The Band Indicia shows available strokes on a per hole basis with the fifth stroke framed. The Rotating Ring plate allows for various functional selections: hole completion, at regulation, hole number or other base unit indicia as required by application.

FIG. 3. Mechanical and Electronic Design Flow: This flow diagram shows the natural split of the mechanical selectable indicia also track-able with position sensors in the electronic form of invention.

FIG. 4. Logic Schematic for Golf Scorer: This electronic logic is developed for the use of whole Indicia integers zero through 9 showing that all integers can be developed and tracked in the base ten system with these ten integers with the use of an additional electronic input.

FIG. 5. Invention on Pill Bottle: The Band and Slider invention is held in place on a varied size and shaped bottle with Band elasticity and frictional forces between the Band and Slider and bottle keep the invention positioned on the bottle. The Band communique is indicated and viewable through the frontal Slider viewing window. There are grasp or grip surfaces to reposition the Slider on the Band protruding away from the base Slider window frame area.

FIG. 6. Slider—Front Face: The Slider is a single piece. The frontal face is primarily characterized by an open-faced viewing window that frames the Band communique. There are Slider grip surfaces extending from the window frame use to grasp and move the Slider to a different communique The Slider has a Pinch Plate (A) back to hold or clasp the Band into the Slider into the Retention Slots (C) but allows the Band to slip through the Slider with intentional force applied. The open face area of the Slider is proportionally sized to the width of the Band and the indicia.

FIG. 7. Slider—Straight Thru Back: The Pinch Plate is temporarily cantilevered away from the frontal area for insertion of the Band onto the Slider. The Pinch Plate is released to normal operation and the Band is not allowed to fall through the Separation Slit. The Band passes straight through the Slider without any angles imparted on the Band. The Slider retains its position on the Band indicia with normal frictional forces generated by the elasticity of the Band when stretched over a non-included unit; therefore, the Slider makes forced contact to the non-included unit.

FIG. 8. Slider—Serpentine Back: The Serpentine Retention Slots (A) where the Pinch Plate imparts minor forces due to curvature to the Band. The Pinch plate imparts a slight curvature on the Band as it enters and exits the Pinch Plate slots creating additional friction between the Band and the Slider as compared to the straight through design.

FIG. 9. Band: The elastomeric Band is an annulus shape or linear with attachable ends. The indicia on the Band are legible through the Slider frontal viewing frame. The Band is of two different friction designs: with protuberances and without protuberances. In both designs, the indicia are legible and sized to maximize the Slider's front face viewing frame. Depicted in this drawing is the annulus Band without protuberances.

FIG. 10. Invention on Wrist: The elastomer Band fits over a range of shapes and diameters. When the Band-Slider fits loosely, as over wrist, or addition friction is required protuberances are added to the Band to maintain the Slider position on the Band. The protuberance Band design has centering protuberances and side protuberances.

FIG. 11. Band with Protuberances: The Band has protuberances separating the communique and a centering protuberance on the Band back. These protuberances keep the Slider from unintentionally moving off the chosen communique. The protuberances do not prohibit intentional repositioning of the Slider on the Band.

FIG. 12. Slider—Centering Hole in Pinch Plate: A centering hole in the Slider Pinch Plate engages the Band's centering protuberance. The mating of the centering Band protuberance and Slider hole eliminates unwanted slippage between the Band and Slider. This mating between Slider and Band may also be used as the surfaces for electronic pickup.

FIG. 13. Slider: Heart Front and Grip Surfaces: The frontal viewing window (A) is integral with all Slider's as represented here with one variance, a heart shaped Slider. All other Slider and Band embodiments and claims remain.

FIG. 14. Monitoring Band and Slider: In electronic form, the Band and Slider invention has integrated electronics for sensing and storing the relative position of the Slider over the Band Indicia. The position along with time is recorded in a digital electronic chip. The data can be transmitted to a non-included device. There is a power source.

FIG. 15. Two Piece Slider: The two piece Slider retains Band retention slots and the frontal viewing frame. The one piece Slider is split for electronic component insertion into back half and for ease of assembling the Slider over the Band. Insertion pins mated into pin holes hold the two piece Slider unit together. The mechanical function of the Slider remains the same.

FIG. 16. Rotating Ring (AM-PM Daily Dosage): The Slider can be repositioned over various Band Indicia but the Rotating ring is attached to the Slider without interfering with the Slider's window frame. The Rotating Ring with arrow points to either the top half of the base Slider or the bottom half of the base Slider. In this example, the bottom half represents night time or evening and the top half represents day time or morning. The Rotating Ring is repositioned to AM or PM, represented by yellow or black, after the indicated dosage is administered for that day.

FIG. 17. AM-PM Band with Rotating Ring: The Slider is repositionable on the Band but the Band is color coordinated with the top half being different that the bottom half of the Band. The Rotating Ring can point to either the bottom half of the Band or the top half of the Band. The drawing shows AM and PM colors on the Band for indicating evening or morning pill dosages.

FIG. 18 Simple Golf Wristlet: The Slider front face is shaped like a flattened golf ball and frames the Indicia numbers representing golf strokes available for on a hole.

No Rotating Ring is required on this simple design.

FIG. 19. Golf Wristlet with Rotating Ring and Electronics: An electronic LED display is added to the Slider for positive recognition of Slider position on the Band. The LED lights confirm position retention of Slider on Band, Rotating Ring position, data transmission, and incoming signal. The data from repositioning the Slider or the Rotating Ring is stored and transmitted to a non-included device.

TABLE A. (in text). Elastic Forces: Example Band Size to Application Size: This table shows the importance of elasticity in Band design. The Band is of annulus design or linear with fasten-able ends. The elasticity force assists with frictional contact of Band and Slider on non-included device to keep the invention from slipping off the non-included device.

TABLE B. (in text) Mechanical and Electronic Band and Slider Characteristics: This table shows Band and Slider characteristics that may differ based on mechanical only design (INDICIA INDICATING) or mechanical/electrical design (INDICIA RECOGNITION).

The invention claimed is:

1. A cognitive reminder and tracker comprising:

a repositionable slider;

a band; and integrated electronics, wherein the slider visually frames, integers, indicia, icons, or emoticons on the band, wherein the integrated electronics recognizes the position of the slider's relative position on the band and digitally stores the slider's relative position, time duration of the slider's relative position on the band and clock time as data on a data chip, and wherein the data can be transferred from the cognitive reminder and tracker to another device.

2. The cognitive reminder and tracker of claim 1; further comprising a rotating ring coupled to the slider for selecting integers, indicia, icons, or emoticons on the slider for selecting additional electronic modes of the band in conjunction with the slider's relative position on the band, wherein the integrated electronic recognize and store the rotating ring's clock time, and time duration of the rotating ring's relative position on the slider.

3. The cognitive reminder and tracker of claim 1 or claim 2, further comprising a transmitter for transmittal to or retrieval by another device through direct connection, radio frequency, cell phone, or cell phone application for further characterization.

4. The cognitive reminder and tracker of claim 1 further comprised of, frictional forces created with band elasticity, band protuberances, raised band indicia or a slider pinch plate keep the slider on the band in a relative position over an indicia, icon, or emoticon, wherein elastic and frictional forces retain band and slider invention on a non-included structure.

5. The cognitive reminder and tracker of claim 2 further comprising colored LED signature lights confirming successful electronic slider and rotating ring position recognition and data delivery.

6. The cognitive reminder and tracker of claim 2 further comprised of a non-included programmable receiver or transmitter, that contains instructions for slider and rotating ring data to further define, characterize, total, retransmit, and time coordinate.

7. The cognitive reminder and tracker of claim 1 or claim 2, further comprising a pill dosage tracker and reminder system with indicia, icons, or emoticons representing day of week, AM-PM, morning/afternoon/night, and/or integers.

8. The cognitive reminder and tracker of claim 2, comprised of a golf strokes system for tracking on a per hole basis an 18 hole round of golf, wherein the band and rotating ring indicia are integers one through eighteen, and optionally zero, with-the slider's integers, indicia or icons and rotating ring's indicia, integers, or icons tracking actual strokes, actual stroke comparisons to regulation, strength of hole handicap, and a total round score.

9. The cognitive reminder and tracker of claim 2, comprised of a daily caloric intake system with major numerical indicia increments of 400, 800, 1200, 1600, 2000, and 2400 representing calorie intake for a day, wherein the rotating ring contains indicia, icons, or emoticons representing fruit, dairy, meat, vegetables, nuts, and legumes or day of week.

10. The cognitive reminder and tracker of claim 1 comprising a voting system with indicia, icons, or emoticons representing a team player jersey number, YES/NO, happy/sad or integers.

11. The cognitive reminder and tracker of claim 1 or claim 2 further comprising a receiver and color LED light signatures recognizing in-bound data types accepted from a specified non-included unit, wherein the data types may include incoming cell phone call and successful transmission and receipt of data by the non-included unit.

12. The cognitive reminder and tracker of claim 1 further comprising annulus band geometry or of linear band geometry which has connecting ends such as a clasp, buckle, or hook and loop.

13. The cognitive reminder and tracker of claim 1 further comprising of a power source, transmitter, radio frequency chip, receiver, or data port.

14. The cognitive reminder and tracker of claim 2 wherein the rotating ring remaining in position through ring to slider bezel indentations and friction until intentional rotation.

15. The cognitive reminder and tracker of claim 1 or claim 2 further comprised of a daily routines tracking system represented by icons or emoticons for phone, school, pharmacy, pickup, music, or sports.

* * * * *